United States Patent [19]

Bauch

[11] Patent Number: 4,577,537

[45] Date of Patent: Mar. 25, 1986

[54] STAPLE FIBER CUTTING MACHINE

[75] Inventor: Ernst Bauch, Bordesholm, Fed. Rep. of Germany

[73] Assignee: Neumuenstersche Maschinen- und Apparatebau Gesellschaft mbH (NEUMAG), Neumuenster, Fed. Rep. of Germany

[21] Appl. No.: 651,638

[22] Filed: Sep. 17, 1984

Related U.S. Application Data

[63] Continuation of Ser. No. 341,161, Jan. 19, 1982, abandoned.

[30] Foreign Application Priority Data

Feb. 18, 1981 [DE] Fed. Rep. of Germany ..... 3105877

[51] Int. Cl.[4] ..... D01G 1/04

[52] U.S. Cl. ..... 83/343; 83/431; 83/678; 83/698; 83/913

[58] Field of Search ..... 83/913, 343, 346, 699, 83/431, 698, 678; 16/0.6, 0.62, 0.64, 0.3

[56] References Cited

U.S. PATENT DOCUMENTS

| | | | |
|---|---|---|---|
| 3,777,610 | 12/1973 | Spaller, Jr. | 83/913 |
| 4,169,397 | 10/1979 | Vehling et al. | 83/913 |
| 4,300,422 | 11/1981 | Potter | 83/165 |
| 4,343,069 | 8/1982 | McLuskie et al. | 83/913 |
| 4,345,355 | 8/1982 | Berchoux et al. | 83/913 |

*Primary Examiner*—Frank T. Yost
*Assistant Examiner*—Hien H. Phan
*Attorney, Agent, or Firm*—Michael J. Striker

[57] ABSTRACT

A staple fiber cutting machine for continuously cutting cables of synthetic fibers, has a rotation-symmetrical rotary cutter supporting member provided with a plurality of cutters, a ring member mounted on end portions of the cutters and defining an inlet slot for a cable, and a drum member mounted on an outer side of the ring member and having an inner diameter substantially corresponding to an inner diameter of the ring member, and a length that could be anything but shorter than the small spacings between cutting edges of two neighboring cutters.

10 Claims, 3 Drawing Figures

STAPLE FIBER CUTTING MACHINE

This is a continuation of application Ser. No. 341,161, filed Jan. 19, 1982, now abandoned.

BACKGROUND OF THE INVENTION

The present invention relates to a staple fiber cutting machine, particularly for continuously cutting cables of synthetic fibers.

In the processes of cutting of staple fibers, a uniform staple length with as small as possible scattering width is desired. In practice, these requirements which are conditional upon the subsequent working however are not sufficiently satisfied. A staple fiber cutting machine in accordance with U.S. Pat. No. 4,343,069 is characterized by the fact that when the cutter supporting member rotates with high number of revolutions, non-uniform staple lengths are obtained. In accordance with the considerations of the inventor, this effect can be explained in the following way. With the high number of revolutions of the cutter supporting member a considerable centrifugal force acts upon the end of the cable which rotates together with the cutter supporting member and has been just cut, so that the centrifugal force pulls the cable end outwardly. This pulling force causes a stretching which is not limited only to the free cable end hanging outwardly, but extends also into the region in which the cable abuts against the cutters ready for the action. The stretching depends upon the friction and other uncontrollable factors. Thereby, the cable is cut in more or less stretched condition. As a result of this, the length of the staple fibers deviates more or less from the ideal length which is determined by the distance between two neighboring cutting edges.

SUMMARY OF THE INVENTION

Accordingly, it is an object of the present invention to provide staple fiber cutting machine which avoids the disadvantages of the prior art.

More particularly, it is an object of the present invention to provide a staple fiber cutting machine which considerably reduces undesirable scattering of the staple length.

In keeping with these objects and with others which will become apparent hereinafter, one feature of the present invention resides, briefly stated, in a staple fiber cutting machine which is provided with a drum member mounted on an outer side of a ring member and having an inner diameter substantially corresponding to an inner diameter of the ring member and a length substantially corresponding to a distance between cutting edges of two neighboring cutters.

When the staple fiber cutting machine is designed in accordance with the present invention, the drum laterally supports the end of the cable to be cut so that the centrifugal force is completely compensated. The results obtained from the operation of such a staple fiber cutting machine has proved that the lengths spectrum became considerably uniform.

The present invention deals, first of all, with an improvement of a staple fiber cutting machine including a rotation symmetrical rotary cutter supporting member with a plurality of cutters, a ring member mounted on end portions of the cutters and forming an annular passage together with the latter, and a pressing member extending into the annular gap, forming an inner slot for a cable and rotatable about an axis which is inclined to the axis of the cutter supporting member. The inventive features in provision in the above-described drum member can also be utilized in other staple fiber cutting machines with similar highly advantageous results.

In accordance with another advantageous feature of the present invention, the drum member has an inner surface which is somewhat conically increased toward the open end of the drum member. When the drum member is designed in accordance with these features, the discharge of the staple fibers is facilitated. At the same time, from the above-presented considerations, it is attained that the angle of inclination of the sphere (the half sphere angle) must be not greater than the friction angle between the fiber material and the drum.

In accordance with still another feature of the present invention a hub is provided centrally of the drum member and connected with the latter by a plurality of spikes. In such a construction, the rim of the cutter supporting members is not additionally loaded by the drum member.

A further feature of the present invention is that the drum member, the hub and the spikes together form a one-piece element, an the hub is readily detachably connected at its end side with the cutter supporting member. When the drum is designed in accordance with these features the exchange and mounting of the drum member is considerably facilitated.

Still a further feature of the present invention is that a further ring member is arranged between the cutter supporting member and the hub and have slots for receiving the inner ends of the cutters. This construction guarantees reliable mounting of the inner ends of the cutters.

In accordance with an especially advantageous feature of the present invention, the ring member is fixedly connected with the drum member. Contrary to the known staple fiber cutting machines disclosed in the above-mentioned U.S. Patent, wherein the ring is held only by the cutter supporting member, the drum member of the inventive construction serves for holding the ring member. The cutter supporting member is thereby completely unloaded. A further advantage of this construction is that it is easier to mounting.

An additional feature of the present invention is that an additional ring member may be arranged between the first-mentioned ring member and the drum member and provided with slots for receiving the outer ends of the cutters. Thus, the reliable gripping of the outer ends of the cutters is guaranteed.

Still another feature of the invention is that the drum member has an open end which faces downwardly. In such a drum member, the dropping of the cut staple fibers is facilitated.

Finally, the machine comprises means for turning it about a horizontal axis. As a result of this, the machine is easily accessible for mounting works.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
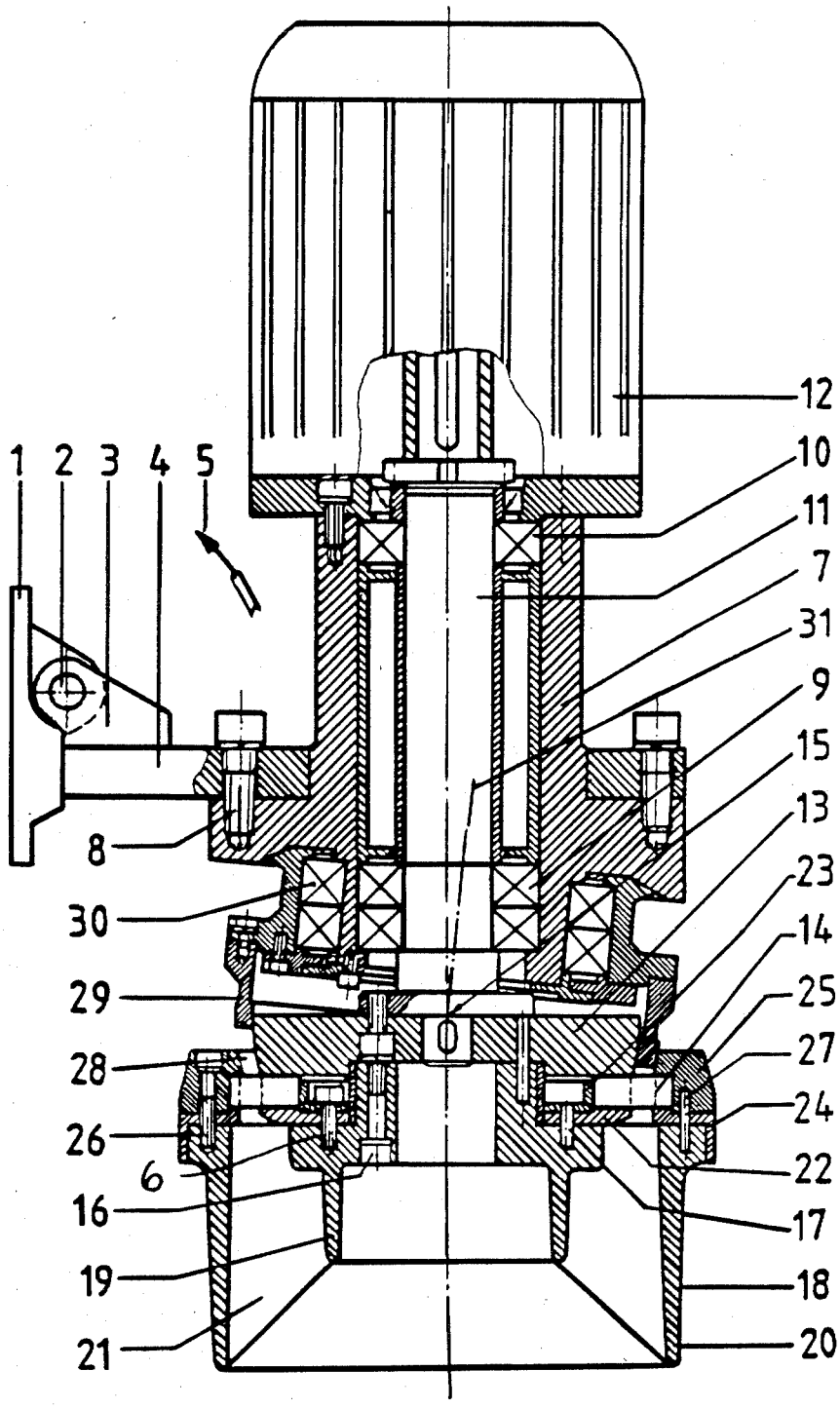
FIG. 1 is a view showing a section of a staple fiber cutting machine in accordance with the present invention.

A staple fiber cutting machine has a stationary machine frame identified by reference numeral 1 and shown only partially. A plate 4 is mounted on the frame 1 with the aid of a pivot pin 2 and an ear 3. The plate 4 can be turned from the shown horizontal operational position in direction of the arrow 5 about substantially 90°.

A cylindrical bearing housing 7 is arranged in an opening of the plate 4 and has a collar shaped portion connected by screws 8 with the plate 4. A shaft 11 is supported in the housing 7 with the aid of bearings 9 and 10. The shaft 11 is driven by a motor 12 mounted via a flange on the upper end of the housing 7. The shaft 11 has a lower end portion on which a cutter supporting member 13 is mounted. Cutters 14 extend radially outwardly beyond the cutter supporting member 13. The cutters 14 have cutting edges facing upwardly. The peripheral face of the cutter supporting member 13 in the region above the plane of the cutter edges of the cutters is formed as a spherical zone. A central point 15 of the sphere of this spherical zone corresponds to the central point of the upper end face of the cutter supporting member 13.

An element 18 is mounted on the cutter supporting member 13 by at least one screw 6 and pins 17. The element 18 includes a ring-shaped hub 19, a drum 20 surrounding the hub 19 and coaxial therewith, and three spokes 21 which connect the hub 19 with the drum 20 and are spaced from one another in a circumferential direction by uniform angular distances of 120°. The drum 20 has a smooth inner wall which insignificantly expands downwardly toward an open end of the drum. The length of the drum 20 substantially corresponds to its inner radius. This drum length is selected upon the consideration that normally at least six cutter 14 are available. When six cutters are uniformly distributed over the periphery, the staple length is equal to the lateral length of the uniform hexagons formed by the cutting edges of the cutters or in other words, equal to the radius of the described circle and thereby equal to the drum length. When more than six cutters are provided, the same drum or a respectively shorter drum can be utilized. Thereby the three cutters coincide with the three spokes 21 of the drum 20 when the number of cutters is a multiple of three, so as to affect the discharge of staple fibers through the spokes 21 as little as possible. The other cutters are arranged in the intermediate spaces between the spokes 21.

A ring 21 is arranged between the hub 19 and the cutter supporting member 13 and provided with, for example, 27 radial slots uniformly distributed over the periphery. Inner ends of the cutters 14 are inserted into the slots of the ring 22. A supporting ring 23 secures the cutters 14 in their radial position. On the upper end face of the drum 20, a ring 24 forming a counter piece for the ring 22 extends in the same plane and has respective radial slots for receiving outer ends of the cutters 14. The ring 24 is arranged between the drum 20 and a further ring 25 which is connected by screws 26 and pins 27 fixedly to the drum 20. The ring 25 overlaps the outer edges of the cutters like a covering cap.

The ring 25 has an inner face facing toward the spherical face of the cutter supporting member 13 and forming a concentrical hollow spherical zone. An annular passage 28 is formed therebetween. The inner diameter of the ring 25 and the inner diameter of the ring 24 corresponding thereto are approximately equal to the inner diameter of the drum 20, and in any case are not greater. A pressing ring 29 is rotatably mounted via an inclined bearing 30 about an axis 31 which is inclined to a geometrical axis of the shaft 11 and intersects the latter in a center point 15 of the sphere. The pressing ring 29 extends at the right side of the drawing into the annular gap 28 with a small lateral play to a region of the cutting edges of the cutters. At the left side, a slot remains because of the above-mentioned inclined position, for a tangentially introducable cable. At least in the vicinity of the end face facing toward the cutters 14, the outer face and the inner face of the pressing ring 29 corresponds to the spherical lateral limiting faces of the annular gap 28.

Figure 2:
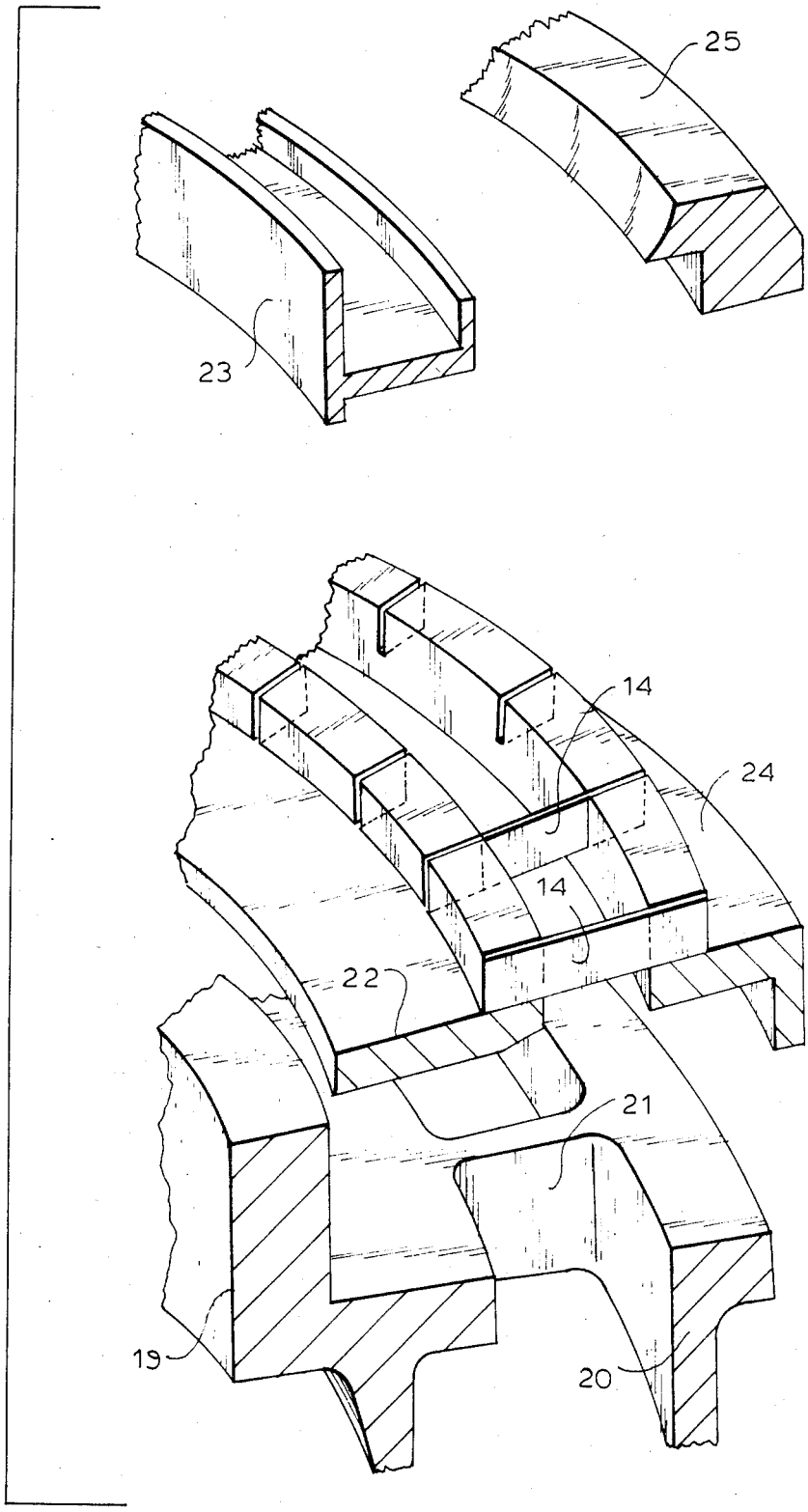
FIG. 2 is a perspective view showing respective parts of the invention shown in FIG. 1; and FIG. *2a* is a perspective view showing a fragment of FIG. 2 on enlarged scale.
Figure 2A:
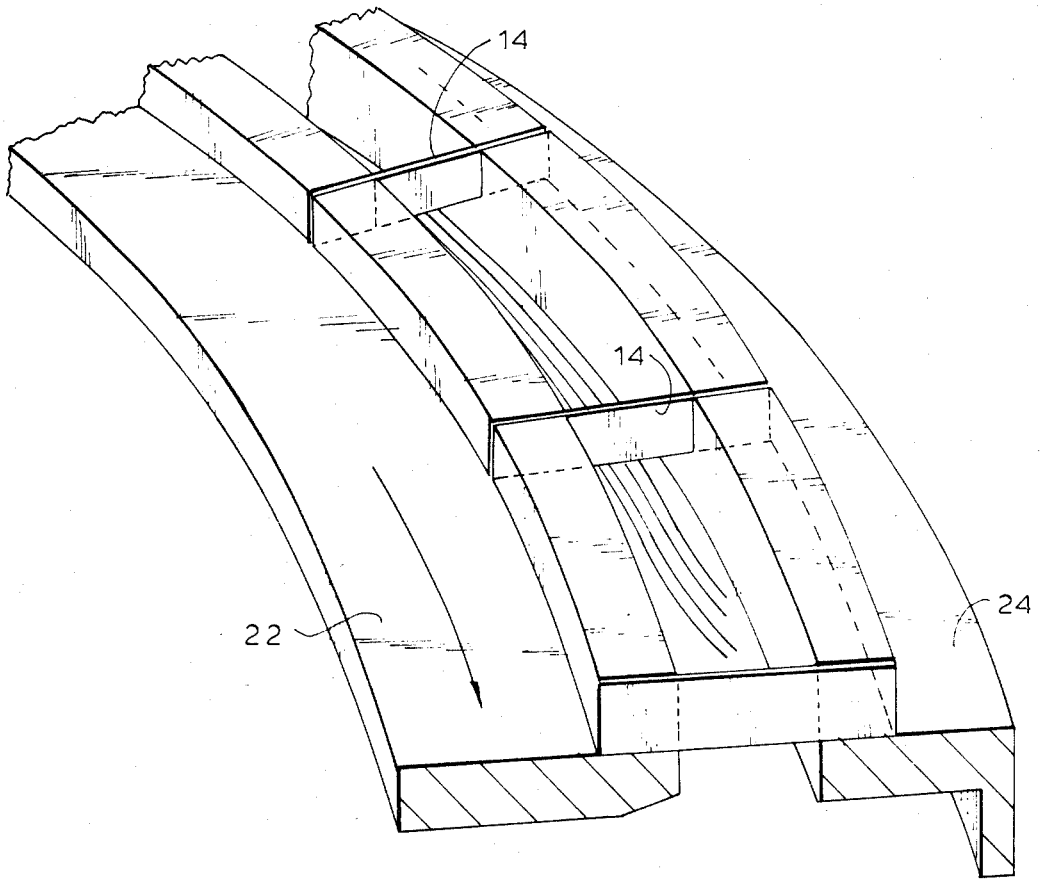

Referring to FIG. 2, the cutters 14, which are shaped as small rectangles, are arranged in the slots of the rings 22 and 24. By insertion of the supporting ring 23 into the ring 22, the cutter is supported radially inwardly. By insertion of the ring 25 which in assembled condition overlaps the outer end of the cutter, the outer cutter ends are secured against falling out. The inner ends in assembled condition are secured by the not shown cutter supporting member 13, on which the rings 22 and 23, etc., are mounted. The cable lies in the groove between the cutter supporting member 13 and the ring 25 on the cutter edges of the cutter. It is pressed by the inclined pressing ring 29 at the narrowest point agaist the cutting edges and thereby cuts in pieces whose length is equal to the distance between the neighboring cutters.

The staple fiber cutting machine in accordance with the present invention operates in the same manner as the staple fiber cutting machine described in the above-mentioned U.S. Pat. No. 4,343,069. The cut off staple fibers are pressed immediately after the cut by the centrifugal force against the inner wall of the drum 20 and fall under the action of their weight in a not shown receptacle associated with the machine. This phenomenon is increased because of the conical construction of the drum inner face by a component of the centrifugal force. The cut staple fibers are then pneumatically transported from the above-mentioned receptacle. The free cable end is laterally supported over its entire length by the drum so as to eliminate any pulling force.

It will be understood that each of the elements described above, or two or more together, may also find a useful application in other types of constructions differing from the types described above.

While the invention has been illustrated and described as embodied in a staple fiber cutting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A staple fiber cutting machine for continuously cutting cables of synthetic fibers, comprising a rotation-symmetrical rotary cutter supporting member having an outer surface and an axis and rotatable with a predetermined speed; a plurality of cutters provided with radially extending upwardly facing cutting edges, distributed over a periphery of said cutter supporting member, and having end portions extending outwardly beyond the latter; a first ring member having an inner diameter and being mounted on said end portions of said cutters and forming together with said outer surface of said cutter supporting member an annular passage, said first ring member having an outlet side; a pressing member extending at one portion of its periphery into said annular passage with a lateral play and to said cutting edges of said cutter, and forming at another portion of its periphery an inlet slot for a cable having an end, said pressing member being rotatable about an axis which is inclined to said axis of said cutter supporting member and with a speed substantially corresponding to said speed of the latter; a rotatable drum member having an inner diameter substantially corresponding to said inner diameter of said first ring member, and a length that could be anything but shorter than the distance between said cutting edges of two neighboring ones of said cutters, said outlet side of said first ring member being fixedly connected to said drum member so that said drum member laterally supports the end of the cable to be cut and so that the centrifugal force, created by said rotary cutter supporting member, that would tend to pull the cable end outwardly is compensated so as to assure that the cut cables are of uniform length; a hub having an end side and being oriented coaxially of said drum member; and a plurality of spokes extending between and connecting together said drum member and said hub so that said hub, said drum member and said spokes form a one piece element, said hub being further connected at its end side with said cutter supporting member.

2. A staple fiber cutting machine as defined in claim 1, wherein said cutter supporting member and said ring member have substantially spherical faces forming a substantially spherical hollow zone, said other portion of said pressing member substantially corresponding to said spherical faces of said cutter supporting member and said ring member, and said axis of said pressing member intersecting said axis of said cutter supporting member in a center of said spherical zone.

3. A staple fiber cutting machine as defined in claim 1, wherein said drum member has an inner surface which is substantially cylindrical.

4. A staple fiber cutting machine as defined in claim 1, wherein said drum member has an open end and an inner surface which is somewhat conically increases toward said open end.

5. A staple fiber cutting machine as defined in claim 1, wherein said cutters have inner ends; and further comprising a further ring member arranged between said cutter supporting member and said hub and having slots for receiving said inner ends of said cutters.

6. A staple fiber cutting machine as defined in claim 1, wherein said ring member is fixedly connected with said drum member.

7. A staple fiber cutting machine as defined in claim 6, wherein said cutters have outer ends; and further comprising an additional ring member arranged between said first-mentioned ring member and said drum member and having slots for receiving said outer ends of said cutters.

8. A staple fiber cutting machine as defined in claim 1, wherein said drum member has an open end which faces downwardly.

9. A staple fiber cutting machine as defined in claim 1; and further comprising means for turning said members about a horizontal axis.

10. A staple fiber cutting machine for continuously cutting cables of synthetic fibers, comprising a rotation-symmetrical rotary cutter supporting member having an outer surface and an axis and rotatable with a predetermined speed; a plurality of cutters provided with radially extending upwardly facing cutting edges, distributed over a periphery of said cutter supporting member, and having end portions extending outwardly beyond the latter; a ring member having an inner diameter and being mounted on said end portions of said cutters and defining an inlet slot for a cable having an end, said ring member having an outlet side; a rotatable drum member having an inner diameter substantial corresponding to said inner diameter of said ring member, and a length that could be anything but shorter than the distances between said cutting edges of two neighboring ones of said cutters, said outlet side of said first ring member being fixedly connected to said drum member so that said drum member laterally supports the end of the cable to be cut and so that the centrifugal force, created by said rotary cutter supporting member, that would bend to pull the cable end outwardly is compensated so as to assure that the cut cables are of uniform length; a hub having an end side and being oriented coaxially of said drum member; and a plurality of spokes extending between and connecting together said drum member and said hub so that said hub, said drum member and said spokes from a one piece element, said hub being further connected at its end side with said cutter supporting member.

* * * * *